US005836689A

United States Patent [19]

Wieland

[11] Patent Number: 5,836,689

[45] Date of Patent: Nov. 17, 1998

[54] DEVICE FOR KNEADING HIGH-CONSISTENCY FIBER PULP

[75] Inventor: Ulrich Wieland, Berg, Germany

[73] Assignee: Voith Sulzer Stoffaufbereitung GmbH, Ravensburg, Germany

[21] Appl. No.: 854,182

[22] Filed: May 9, 1997

[30] Foreign Application Priority Data

May 10, 1996 [DE] Germany ..... 196 18 886.5

[51] Int. Cl.[6] ..... B01F 7/04

[52] U.S. Cl. ..... 366/303; 366/325.2

[58] Field of Search ..... 366/303, 304, 366/305, 307, 325.1, 325.2, 81, 82, 328.1, 329.1, 329.2; 241/46.06, 46.17, 46.11, 190, 236, 243, 261

[56] References Cited

U.S. PATENT DOCUMENTS

| | | | |
|---|---|---|---|
| 1,711,154 | 4/1929 | Michal | 366/303 |
| 1,977,955 | 10/1934 | Robinson | 366/303 |
| 2,283,008 | 5/1942 | Le Bar et al. | 366/303 |
| 2,520,424 | 8/1950 | Mills et al. | 366/303 |
| 3,169,752 | 2/1965 | De Laubarede | 366/81 |
| 3,788,609 | 1/1974 | Toczyski | 366/303 |
| 3,938,783 | 2/1976 | Porter | 366/307 |
| 4,708,623 | 11/1987 | Aoki et al. | 366/81 |
| 4,960,328 | 10/1990 | Schumacher et al. | 366/307 |
| 5,032,073 | 7/1991 | Moyer, III | 366/81 |
| 5,362,146 | 11/1994 | Nogossek | 366/307 |
| 5,407,268 | 4/1995 | Henrich | 366/156.1 |
| 5,450,368 | 9/1995 | Kubota | 366/307 |

FOREIGN PATENT DOCUMENTS

| | | | |
|---|---|---|---|
| 1184393 | 10/1957 | France | 366/303 |
| 446025 | 7/1927 | Germany | 366/303 |
| 4237433 | 5/1993 | Germany . | |
| 278575 | 2/1952 | Switzerland | 366/303 |

*Primary Examiner*—Tony G. Soohoo
*Attorney, Agent, or Firm*—Greenblum & Bernstein P.L.C.

[57] ABSTRACT

Kneading device for high-consistency fiber pulp that includes at least two substantially rotationally symmetrical and coaxial kneading machines, that are movable relative to each other. The kneading machines may include teeth in ring-shaped tooth rows forming ring shaped gaps between the tooth rows and positioned relative to one another such that at least one tooth row of one of the at least two kneading machines reaches into the ring-shaped gaps of an other of the at least two kneading machines. A face side of at least a portion of the teeth may include an angled surface for diverting the fiber pulp in a transport direction, provided by a throughput of a flow of the fiber pulp through the kneading device and by relative movement between the fiber pulp and the face side. At least a portion of the teeth may include angled surfaces on a rear side. An angle $\alpha 1$ of a slope on the face side may differs from an angle $\alpha 2$ of the rear side by at least 5°, and at least a portion of the teeth may be mounted in a releasable fashion, so that a position of the face side and the rear side may be exchangeable by rotating the teeth.

20 Claims, 2 Drawing Sheets

DEVICE FOR KNEADING HIGH-CONSISTENCY FIBER PULP

CROSS-REFERENCE OF RELATED APPLICATION

The present invention claims the priority under 35 U.S.C. § 119 of German Patent Application No. 196 18 886.5 filed on May 10, 1996, the disclosure of which is expressly incorporated by reference herein in its entirety.

BACKGROUND OF THE INVENTION

1. Field of the Invention

The present invention relates to a device for kneading high-consistency fiber pulp including at least two substantially rotationally symmetrical, coaxial kneading machines, movable relative to each other, and having teeth in ring-shaped toothed rows. Between the toothed rows, ring shaped gaps or voids may be formed and the at least two kneading machines may be arranged such that a toothed row and a ring shaped gap of a first kneading machine is positioned within a ring shaped gap and a toothed row of a second kneading machine, respectively. A face side of at least a portion of the teeth may include an angled surface for diverting the fiber pulp, through a relative movement between the fiber pulp and the face side, in the transport direction. The transport direction may further result from a throughput of a flow of fiber pulp through the at least two kneading devices in which at least a portion of the teeth may also include angled surfaces on a rear side. A first angle $\alpha 1$ of a slope on the face side may differ from an angle $\alpha 2$ of the rear side by at least 5°. Further, at least a portion of the teeth may be mounted in a releasable fashion, so that a position of face side and rear side may be exchangeable by rotating the teeth.

2. Background and Material Information

A kneading device similar in general to the above described device is discussed, e.g., in DE-42 37 433 A1. This device, suitable for kneading wastepaper, serves to process the pulp in an intense mechanical and optionally thermal treatment process to remove contaminants and to cut up and/or bring contaminants below the range of visibility. Other applications of similar kneading devices are, e.g., for processing either fiber pulp or waste paper to a desired curl. The processed fiber pulp or waste paper thus acquires specific improvements, e.g., increased volume. The starting material for the kneading process enters the device already exhibiting a kneadable or soft-crumbly texture, and, thus, is not comparable with wood chips or even coarser materials. Further, in contrast to, e.g., paper pulp grinding refiners, which process the pulp in a slushy suspension, kneading devices produce a high-consistency pulp, preferably with a dry content between 15 and 40%. In this manner, significant sheer forces are be transferred to the pulp, such that the above-mentioned objectives are carried out without a significant change in fiber length. In many cases the effect of the mechanical treatment is further enhanced with heat, e.g., by adjusting the fiber pulp temperature to 90° C. or higher.

Generally, the pulp remains in a treatment chamber of the kneading device for between 15 seconds and several minutes, and, because of the device has a spacing of more than 3 mm between the tools, the pulp is processed predominantly by friction between fibers. It is known that, in this process, the fibers are treated with care and the treatment machines are only slowly worn out. The fundamentals of the process are generally recognizable from arrangements shown in, e.g., DE-42 37 433 A1. That is, the rotor is substantially cylindrical, and the pulp is axially transported between stationary and moving kneading teeth. Such kneaders have been effective for a long period of time, particularly for waste paper applications. Transport of the pulp through the processing zone is ensured by an angled positioning of processing teeth and a suitable transport device, e.g., a worm drive or helix formed on the kneader shaft. Thus, the transport parameters of the device are virtually fixed.

SUMMARY OF THE INVENTION

The present invention may create a device for kneading high-consistency fiber pulp that enables a changing of a transport movement in a processing zone without considerable additional expenditure.

The above-noted object may be achieved with a device that may include at least two substantially rotationally symmetrical, and coaxial kneading machines which move relative to each other. The at least two machines may include teeth in ring-shaped toothed rows forming ring shaped gaps or voids between the ring shaped toothed rows. The at least two kneading devices may be positioned such that a toothed row and ring shaped gap of a first kneading device may be aligned with a ring shaped gap and a toothed row of a second kneading device, respectively. A face side of at least a portion of the teeth may include an angled surface that diverts the fiber pulp, through a relative movement between the fiber pulp and the face surface, into a transport direction that may also result from a throughput of a flow of fiber pulp through the kneading device. At least a portion of the teeth may also include angled surfaces on a rear side. An angle $\alpha 1$ of a slope on the face side may differ from an angle $\alpha 2$ of the rear side by at least 5° and at least a portion of the teeth may be mounted in a releasable fashion so that the positions of the face side and the rear sides may be exchangeable by rotating the teeth.

The face side of teeth of a kneading device may move in a relative fashion toward the pulp. Since the slope on the face side causes a plow and diversion movement on the transported pulp in a direction of flow, the pulp transport operation in the kneader device is achieved. A pre-condition for the plow and diversion movement on the transported pulp is a relative movement between the inclined or angled surface of a tooth and the fiber pulp, which may be created either by a relevant tooth of a moving kneading machine or by a stationary tooth positioned within a circumferentially moving pulp flow path. According to the present invention, the rear side of the tooth may be utilized as the front side by rotating a tooth or a group of teeth of one or several kneading machines. Because the transport effect depends on the angle that the angled surface exhibits relative to the direction of movement of the tooth or on the flow direction of the pulp with respect to the stationary tooth, varying transport effects can be achieved from different slope angles by rotating such a tooth, for example by 180°.

The rotation of the teeth in the prescribed manner leads to a simple change in the transport effect on the relevant tooth. Such a change may be advantageous if conditions have to be considered in the design of the machine that do not meet the original standards. This can, e.g., be a requirement for a larger or smaller throughput. In addition, it may be advantageous to specifically target transport operations so that in certain parts of the processing areas higher transport velocities may be maintained while in other parts lower transport velocities may be maintained. As a result of this, a compression zone, through which the pulp is necessarily passed through, may be created. The compression zone may, e.g., serve as a steam barrier. However, technological advantages in the actual kneading operation may also be achieved. Such exertion on pulp transport in the kneader can be desired when different application conditions may be performed in a same kneader. In such a case, simply a portion or all of the appropriately equipped teeth have to be rotated for an adjustment. Even in situations in which the slopes of the angled surfaces are initially the same on the face and rear sides, a less worn surface may be made available for transporting pulp via rotation.

In certain extreme cases, e.g., where a pronounced compression of the pulp may be desired in areas, a slope of the angled surface may be selected to slow down the pulp transport. Of course, a preceding or subsequent transport device would be utilized to force the throughput through the machine.

The present invention may be directed to a kneading device for high-consistency fiber pulp that includes at least two substantially rotationally symmetrical and coaxial kneading machines, that are movable relative to each other. The kneading machines may include teeth in ring-shaped tooth rows forming ring shaped gaps between the tooth rows and positioned relative to one another such that at least one tooth row of one of the at least two kneading machines reaches into the ring-shaped gaps of another of the at least two kneading machines. A face side of at least a portion of the teeth may include an angled surface for diverting the fiber pulp in a transport direction, i.e., a throughput of a flow of the fiber pulp through the kneading device, by relative movement between the fiber pulp and the face side and at least a portion of the teeth may include angled surfaces on a rear side. An angle $\alpha 1$ of a slope on the face side may differs from an angle $\alpha 2$ of the rear side by at least 5°, and at least a portion of the teeth may be mounted in a releasable fashion, so that a position of the face side and the rear side may be exchangeable by rotating the teeth.

According to another feature of the present invention, the rotation of the teeth may include a 180° angle.

According to another feature of the present invention, the angle $\alpha 1$ of the slope on the face side may differ from the angle $\alpha 2$ on the rear side by at least 15°.

According to still another feature of the present invention, the transport direction of the fiber pulp may be substantially perpendicular to a plane formed by movement of the teeth.

According to a further feature of the present invention, the transport direction may be an axial direction relative to the kneading machines. Alternatively, the transport direction may include a radial direction having a center substantially aligned with a middle axis of the kneading machines.

According to still another feature of the present invention, a plurality of teeth of the kneading machine may be mounted on a rotatable mounting segment. Further, the rotatable mounting segment may include a closed ring, and may include a ring segment spanning a maximum circumferential angle of 180°.

According to another feature of the present invention, the rotatable mounting segment may include rails axially mounted on the kneading machine and holding teeth that belong to a plurality of rows of teeth.

The present invention may be directed to a kneading device for high-consistency fiber pulp. The device may include a first and second coaxial kneading machine rotatably movable relative to each other and which may include a plurality of toothed rows and a gap formed between the toothed rows. The toothed rows of the first coaxial kneading machine may be arranged to align with the gaps of the second coaxial kneading machine and the toothed rows may include a plurality of teeth having an angled face side for transporting fiber pulp through the kneading device and an angled rear side. The first and second coaxial kneading machines may further include mounting portions for releasably and rotatably mounting the teeth for adjusting a flow of the fiber pulp transported through the kneading device.

According to another feature of the present invention, the teeth may be mounted such that the face side include a leading edge for contacting the fiber pulp during operation. Alternatively, the teeth may be mounted such that the rear side includes a leading edge for contacting the fiber pulp during operation.

According to still another feature of the present invention, the first and second coaxial kneading machines may include a longitudinal member and a cylindrical member.

According to a further feature of the present invention, the first and second coaxial kneading machines may include a pair of coaxial disks.

According to another feature of the present invention, at least a portion of the teeth may include a cross-sectional profile of at least one of substantially an oval shape, a rectangular shape, and a parallelpiped shape.

According to a still further feature of the present invention, the angle of the face side may be at least 5° greater than the angle of the rear side.

According to another feature of the present invention, the angle of the face side may be arranged to transport the pulp fiber axially through the kneading device. Alternatively, the angle of the face side may be arranged to transport the pulp fiber radially through the kneading device.

According to yet another feature of the present invention, the angle of the face side and the angle of the rear side may be formed such that, when the tooth is rotated, the fiber pulp may be moved in a same direction of transport.

Other exemplary embodiments and advantages of the present invention may be ascertained by reviewing the present disclosure and the accompanying drawings.

BRIEF DESCRIPTION OF DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention may be embodied in practice.

Figure 1A:
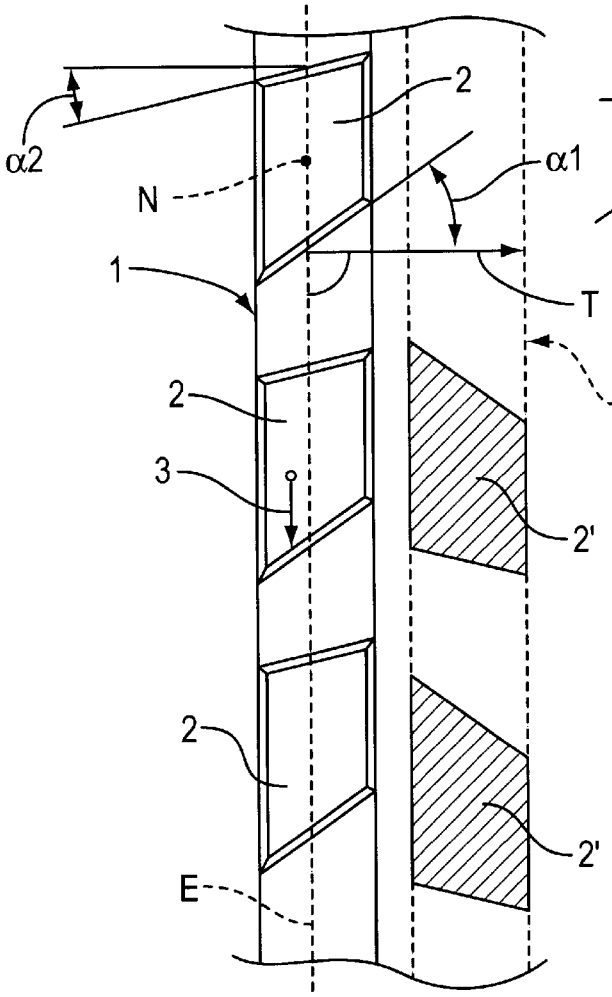
FIGS. 1*a* and 1*b* illustrate an exemplary portion of a kneading device in accordance with the present invention.
Figure 3:
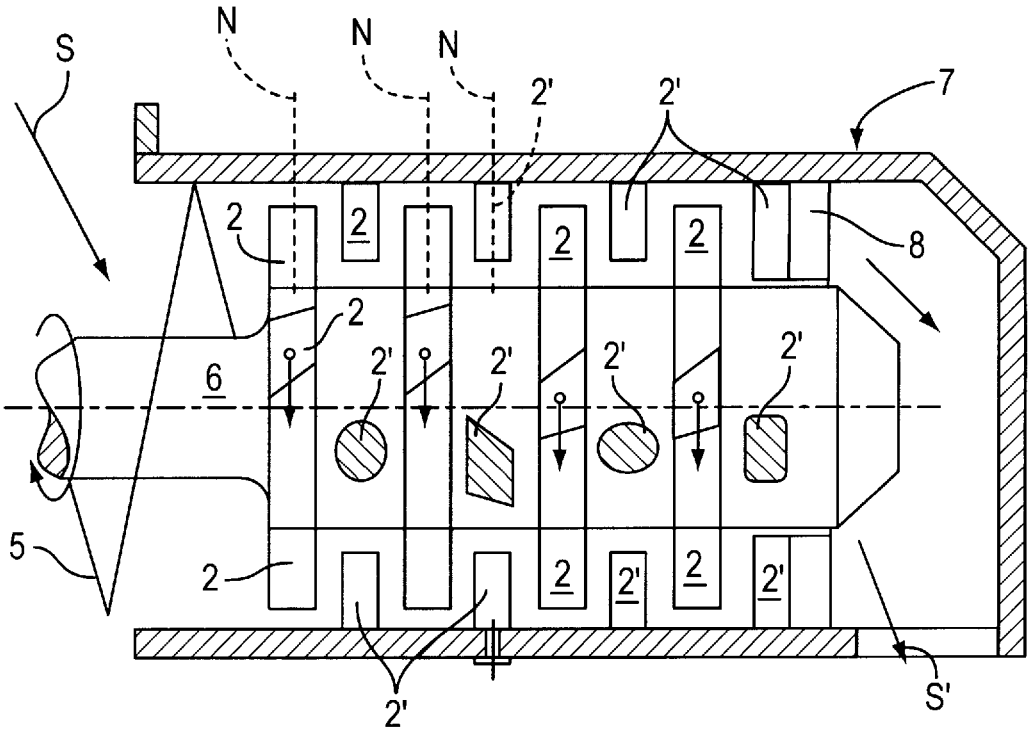
FIG. 3 illustrates a sectional side view of the axial machine.

FIG. 1*a* illustrates, in a rolled-out fashion, a top view of a portion of a movable kneading machine 1 that may be utilized in a kneader device having an axial pulp flow. As shown, a toothed row, comprising a plurality of teeth 2, may be associated with a rotor or moving kneading machine in a circumferential direction 3. Another toothed row, comprising a plurality of teeth 2' (indicated as cross-hatched), may be associated with a stationary kneading machine. Teeth 2 and 2' may be angled on a face side and on a rear side, with respect to a portion of the tooth that processes and transports the fiber pulp through the kneading machine. In the exemplary embodiment shown, teeth 2 and 2' may be formed with substantially a same shape. In an alternative embodiment, e.g., as shown in FIG. 3, teeth 2 and 2' may be formed with different shapes. Due to the particular arrangement of the teeth within the kneading device, teeth 2 may be moved, as discussed above, in circumferential direction 3 during operation. In the exemplary embodiment, teeth 2 may include a tooth base normal N which may be moved in circumferential direction 3 to form a plane E. A transport direction T of the fiber pulp, e.g., the actual pulp transported through the kneading machine, may be formed to be perpendicular to plane E. Of course, a circumferential movement of the fiber pulp may also occur during operation. An angle of the slopes, with respect to transport direction T, may be defined by an angle $\alpha 1$ on the face side and an angle $\alpha 2$ on the rear side, each in position before rotation of the moving kneading device.

Figure 1B:
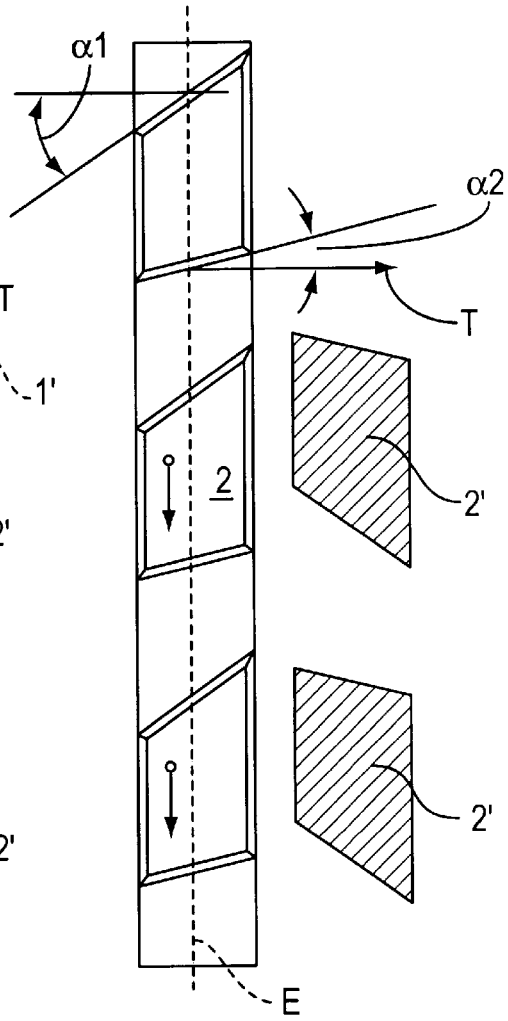

FIG. 1*b* illustrates the exemplary embodiment of FIG. 1*a* after teeth 2 and 2' have been rotated 180°. The transport effect on the face side of teeth 2 may be decreased due to the reduced angle of $\alpha 2$ for the face side. In another alternative embodiment of the present invention, the teeth 2 and 2' may be curved. Further, other shapes or orientations may be available in accordance with the present invention as long as the above-described arrangement for effecting the transport direction T is observed.

Figure 2:
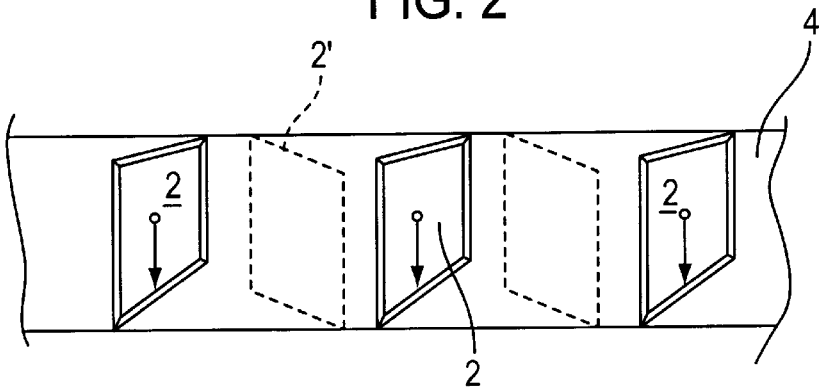
FIG. 2 illustrates a variation of a tooth mounting in the kneading device.

FIG. 2 illustrates a slightly different mounting for teeth 2 in accordance with the present invention. In accordance with this embodiment, a rail 4, which may be utilized in axial machines, may include a plurality of teeth 2. However, in contrast to the embodiments of FIGS. 1*a* and 1*b*, each tooth 2 may belong to a different toothed row of the kneading machine. Further, rotation of the teeth, e.g., in the direction shown by the arrows, may occur by relative rotation rail 4. Thus, rail 4 may be part of a rotor or a stator, which may be longitudinally mounted in a substantially axial orientation.

FIG. 3 illustrates a sectional side view of an axially arranged kneading device, i.e., a kneading device in which a transport movement of the fiber pulp occurs axially. The kneading device depicted in FIG. 3 is for the purpose of illustration of this particular embodiment of the present invention, thus, only a portion of the teeth 2 and 2' actually utilized are shown. At an input portion of the kneading device, fiber pulp S may be pressed into an actual processing zone with a spiral conveyor 5. Several toothed rows may be arranged within the actual processing zone such that teeth 2 and 2' may mounted in an alternating manner on a rotor 6 and on a stator housing 7, respectively. A profile of teeth 2', which are coupled to stator housing 7, are shown in a shaded cross-section. As shown, teeth 2' may include an oval shaped profile with the long axis oriented in predetermined direction, a substantially rectangular shaped profile having rounded edges but substantially without inclination, and a profile substantially similar to the teeth 2' shown in the previous embodiments. As with the previous embodiments, some of the teeth may include a tooth base normal N that, during circumferential movement, defines plane E. An adjustable throttle 8 may be positioned after the last stator portion in the flow direction to achieve a counter-pressure. This counter-pressure may improve the effect of the kneading device. After passing throttle 8, the kneaded pulp may exit stator housing 7, e.g., as shown by arrow S'.

Figure 4:
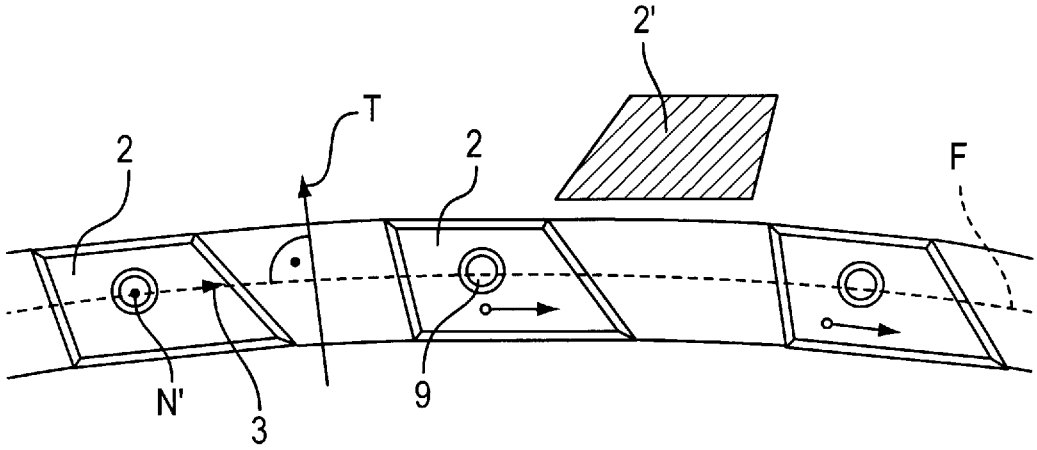
FIG. 4 illustrates a kneading device for a radial machine.

FIG. 4 illustrates a portion of a kneading machine that may be utilized in a radial kneading device. The pulp transport in flow direction T may occur from an inside of the radial kneading device and may be directed radially outward from a center of the kneading device. Through a circumferential movement 3 of a tooth base normal N' of teeth 2, a cylindrical surface F may be defined. Teeth 2 may be individually released for adjusting their rotation orientation by a hole 9 provided for a mounting screw. Tooth 2', which may be associated with the stator, is indicated in cross-hatching. In contrast to the above described embodiments of the invention, the shape of teeth 2' may certainly differ from movable teeth 2. Further, in accordance with the present invention, the rotatable teeth may be arranged to be located on the rotor only, the stator only, or both the rotor and the stator.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A kneading device for high-consistency fiber pulp comprising:

at least two substantially rotationally symmetrical and coaxial kneading machines, that are movable relative to each other, comprising a plurality of teeth in ring-shaped tooth rows forming a ring-shaped gap between the tooth rows and positioned relative to one another such that at least one tooth row of one of the at least two kneading machines reaches into the ring-shaped gaps of another of the at least two kneading machines;

a face side of at least a portion of the teeth comprising an angled surface for diverting the fiber pulp in a transport direction, resulting from a throughput of a flow of the fiber pulp through the kneading device and from relative movement between the fiber pulp and the face side;

at least a portion of the teeth comprising angled surfaces on a rear side;

wherein an angle $\alpha 1$ of a slope on the face side differs from an angle $\alpha 2$ of the rear side by at least 5°, the angles $\alpha 1$ and $\alpha 2$ being defined between the respective face side and rear side relative to the pulp transport direction, and at least a portion of the teeth being mounted in a releasable fashion, so that a position of the face side and the rear side are exchangeable by rotating the teeth.

2. A kneading device according to claim 1, wherein the rotation of the teeth comprises a 180° angle.

3. A kneading device according to claim 1, the angle $\alpha 1$ of the slope on the face side differing from the angle $\alpha 2$ on the rear side by at least 15°.

4. A kneading device according to claim 1, the transport direction of the fiber pulp being substantially perpendicular to a plane formed by movement of the teeth.

5. A kneading device according to claim 4, the transport direction comprises an axial direction relative to the kneading machines.

6. A kneading device according to claim 4, the transport direction comprises a radial direction having a center substantially aligned with a middle axis of the kneading machines.

7. A kneading device according to claim 1, said plurality of teeth of the kneading machine being mounted on a rotatable mounting segment.

8. A kneading device according to claim 7, the rotatable mounting segment comprising a closed ring.

9. A kneading device according to claim 8, the rotatable mounting segment comprising a ring segment spanning a maximum circumferential angle of 180°.

10. A kneading device according to claim 7, the rotatable mounting segment comprising rails axially mounted on the kneading machine and holding teeth that belong to a plurality of rows of teeth.

11. A kneading device for high-consistency fiber pulp comprising:

a first and second coaxial kneading machine rotatably movable relative to each other and comprising a plurality of toothed rows and gaps formed between the toothed rows;

the toothed rows of the first coaxial kneading machine arranged to align with the gaps of the second coaxial kneading machine;

the toothed rows comprising a plurality of teeth having an angled face side for transporting fiber pulp through the kneading device and an angled rear side; and the first and second coaxial kneading machines further comprising mounting portions for releasably and rotatably mounting the teeth for adjusting a flow of the fiber pulp transported through the kneading device in a pulp transport direction.

12. The kneading device according to claim 11, the teeth mounted such that the face side comprises a leading edge for contacting the fiber pulp during operation.

13. The kneading device according to claim 11, the teeth mounted such that the rear side comprises a leading edge for contacting the fiber pulp during operation.

14. The kneading device according to claim 11, the first and second coaxial kneading machines comprising a longitudinal member and a cylindrical member.

15. The kneading device according to claim 11, the first and second coaxial kneading machines comprising a pair of coaxial disks.

16. The kneading device according to claim 11, the teeth comprising a cross-sectional profile of at least one of substantially an oval shape, a rectangular shape, and a quadrilateral shape.

17. The kneading device according to claim 11, the angle of the face side of each tooth relative to the pulp transport direction is at least 5° greater than the angle of the rear side of each tooth relative to the pulp transport direction.

18. The kneading device according to claim 11, the angle of the face side arranged to transport the pulp fiber axially through the kneading device.

19. The kneading device according to claim 11, the angle of the face side arranged to transport the pulp fiber radially through the kneading device.

20. The kneading device according to claim 11, the angle of the face side and the angle of the rear side being formed such that, when the tooth is rotated, the fiber pulp is moved in a same direction of transport.

* * * * *